United States Patent [19]

Thomas

[11] Patent Number: 4,513,224

[45] Date of Patent: Apr. 23, 1985

[54] FLUORESCENT-LIGHTING-SYSTEM VOLTAGE CONTROLLER

[75] Inventor: Stanley N. Thomas, Sunnyvale, Calif.

[73] Assignee: Pacific Power Control, Inc., Sunnyvale, Calif.

[21] Appl. No.: 421,407

[22] Filed: Sep. 22, 1982

[51] Int. Cl.[3] ..... H05B 41/16

[52] U.S. Cl. ..... 315/141; 315/146; 315/276; 315/277

[58] Field of Search ..... 315/146, 276, 144, 141, 315/277, 278

[56] References Cited

U.S. PATENT DOCUMENTS 4,189,664 2/1980 Hirschfeld ..... 315/276

4,219,759 8/1980 Hirschfeld ..... 315/146

*Primary Examiner*—Harold Dixon

*Attorney, Agent, or Firm*—Thomas E. Schatzel

[57] ABSTRACT

A voltage controller for use with a fluorescent-lighting system, the controller including a three-phase transformer having three auto-transformer windings each for developing two reduced voltages, three contactors for selectively coupling the full voltage and the reduced voltages to the lighting system, the contactors being switched in closed-transition fashion to avoid power interruptions, and another contactor for opening the winding-neutral connections during voltage switching to avoid shorting the transformer.

6 Claims, 2 Drawing Figures

FLUORESCENT-LIGHTING-SYSTEM VOLTAGE CONTROLLER

BACKGROUND OF THE INVENTION

1. Field of the Invention

The present invention relates to electric-power controllers generally and more specifically to a fluorescent-lighting-system voltage controller in which auto-transformer taps are switched in closed-transition fashion while the auto-transformer neutral is opened.

2. Description of the Prior Art

When operated at full voltage, many fluorescent (and other gaseous-discharge-type) lighting systems generate lighting levels in excess of those which may be required at a particular time and/or for a particular task. For example, reduced levels may be suitable for janitorial and/or security purposes. Also, reduced levels may be appropriate when suitable levels of natural lighting are available. Further, since the lighting levels (and efficiencies) of fluorescent lamps decrease as the lamps age, many systems may be operated at reduced levels when relatively new lamps are employed therein.

During lamp starting, it is important that fluorescent-lighting systems be operated at full voltage. Thereafter, the voltage may be reduced to reduce lighting levels and power consumption. in general, the power-consumption reduction is in direct proportion to the voltage reduction; and, the reduction in lighting levels is in a linear proportion to the voltage reduction.

A fluorescent-lighting-system-starting and one, or more, reduced voltages are developed by a prior-art-type voltage controller which includes a motor-driven variable transformer. Unfortunately, motor-driven variable transformers suitable for use in the above-mentioned controller are relatively expensive.

Another prior-art-type voltage controller for use with a fluorescent-lighting system is disclosed in the U.S. Pat. No. 4,219,759 which issued to R. Hirschfeld. The controller includes three auto-transformers each connected between a neutral line and a respective one of three hot lines (Y-connection), the lines for connection to a three-phase four-line (AC-voltage-supplying) power system. Each of the auto-transformers has a tap at which the auto-transformer develops a fluorescent-lighting-system-starting voltage and another tap at which the auto-transformer develops a reduced voltage. Also included in the controller are a pair of three-pole magnetic contactors (relays), the contactors for selectively coupling the auto-transformer developed voltages to three additional hot lines, which, with the above-mentioned neutral line, are for connection to the fluorescent-lighting system (as a load). More specifically, each of the three lighting-system hot lines is selectively coupled by a respective set of normally-open contacts of one of the contactors to a respective one of the starting-voltage taps. Additionally, each of the three lighting-system hot lines is selectively coupled by a respective set of normally-open contacts of the other contactor to a respective one of the reduced-voltage taps.

A voltage controller for single-phase systems is disclosed in the U.S. Pat. No. 4,189,664 which also issued to R. Hirschfeld.

Controllers of the type disclosed in the above-mentioned patents are disadvantageous in that they require critical contactor timing. During any period in which the contacts of both contactors are simultaneously closed (make-before-break) a fault condition occurs (as the auto-transformers are shorted). Alternatively, during any period in which the contacts of neither contactor are closed (break-before-make), the power to the fluorescent-lighting system is interrupted (power outage). Such an interruption may cause certain lamps, particularly mercury-vapor-type lamps, to extinguish.

A controller which avoids the above-mentioned power-interruption problem includes three switching reactors in addition to three auto-transformers (or a transformer with three auto-transformer windings) and two contactors, the switching reactors being interposed between the contactors. More particularly, each of the switching reactors has an end which is selectively coupled by a respective set of contacts of one of the contactors to a respective auto-transformer-starting-voltage tap; another end which is selectively coupled by a respective set of contacts of the other contactor to a respective auto-transformer-reduced-voltage tap; and a center tap which is connected to a respective one of three lighting-system hot lines. To avoid power interruptions, the contactor timing is overlapped (make-before-break) to provide what is referred to as "closed-transition switching." During switching, the switching reactors are operative to limit the auto-transformer currents. Unfortunately, the limited currents developed during switching are high (fault level), inductive currents, under which the contactors must open.

Some electric motors are started under reduced voltage. A circuit which provides such a reduced voltage for motor starting and full voltage thereafter is commonly referred to as the Korn-Dorfer method. For three-phase motors, such a circuit includes a transformer having three auto-transformer windings (or three auto-transformers each having one winding). The hot end of each winding is connected to a respective one of three hot lines for connection, with a neutral line, to a three-phase four-line power system. The neutral end of each winding is selectively coupled by a respective set of (neutral) contacts to the neutral line. A reduced-voltage tap on each of the windings is selectively coupled by a respective set of (reduced-voltage) contacts to a respective one of three motor hot lines each of which is also selectively coupled by another respective set of (full-voltage) contacts to a respective one of the three hot power lines. During starting, the neutral contacts and the reduced-voltage contacts are closed; and, the full-voltage contacts are open. After starting, the neutral contacts are opened. Thereafter, the full voltage contacts are closed. Finally, the reduced-voltage contacts are opened.

SUMMARY OF THE PRESENT INVENTION

It is therefore an object of the present invention to provide an inexpensive voltage controller suitable for operating a fluorescent-lighting system at full voltage for starting and one, or more, reduced voltages for energy conservation.

Another object of the present invention is to provide a voltage controller which switches without power interruptions.

Briefly, the preferred embodiments of voltage controllers in accordance with the present invention each include a transformer having three auto-transformer windings each for developing a reduced voltage and a further reduced voltage, a contactor having three sets of contacts connected with the three windings in a Y-configuration for connection across a three-phase four-line (AC-voltage-supplying) power system, the contactor for selectively opening each of the winding-neutral connections, and three additional contactors each having three sets of contacts for selectively coupling a respective power system voltage or one of the respective voltages developed by each winding to the lighting system. The latter contactors being switched in closed-transition fashion to avoid power interruptions, the switching occurring while the neutral contactor opens the winding-neutral connection to avoid fault-level switching currents.

A material advantage of the present invention is the ability it affords to provide an inexpensive voltage controller which switches without power interruptions or fault level currents.

Another advantage of the present invention is its simplicity.

These and other objects and advantages of the present invention will no doubt become obvious to those skilled in the art after having read the detailed description of the preferred embodiments which are illustrated in the figures of the drawing.

IN THE DRAWING

FIG. 1 is a schematic diagram of a preferred embodiment of a voltage controller in accordance with the present invention; and FIG. 2 is a schematic diagram of another preferred embodiment of a voltage controller in accordance with the present invention.

DETAILED DESCRIPTION OF THE PREFERRED EMBODIMENTS

Figure 1:
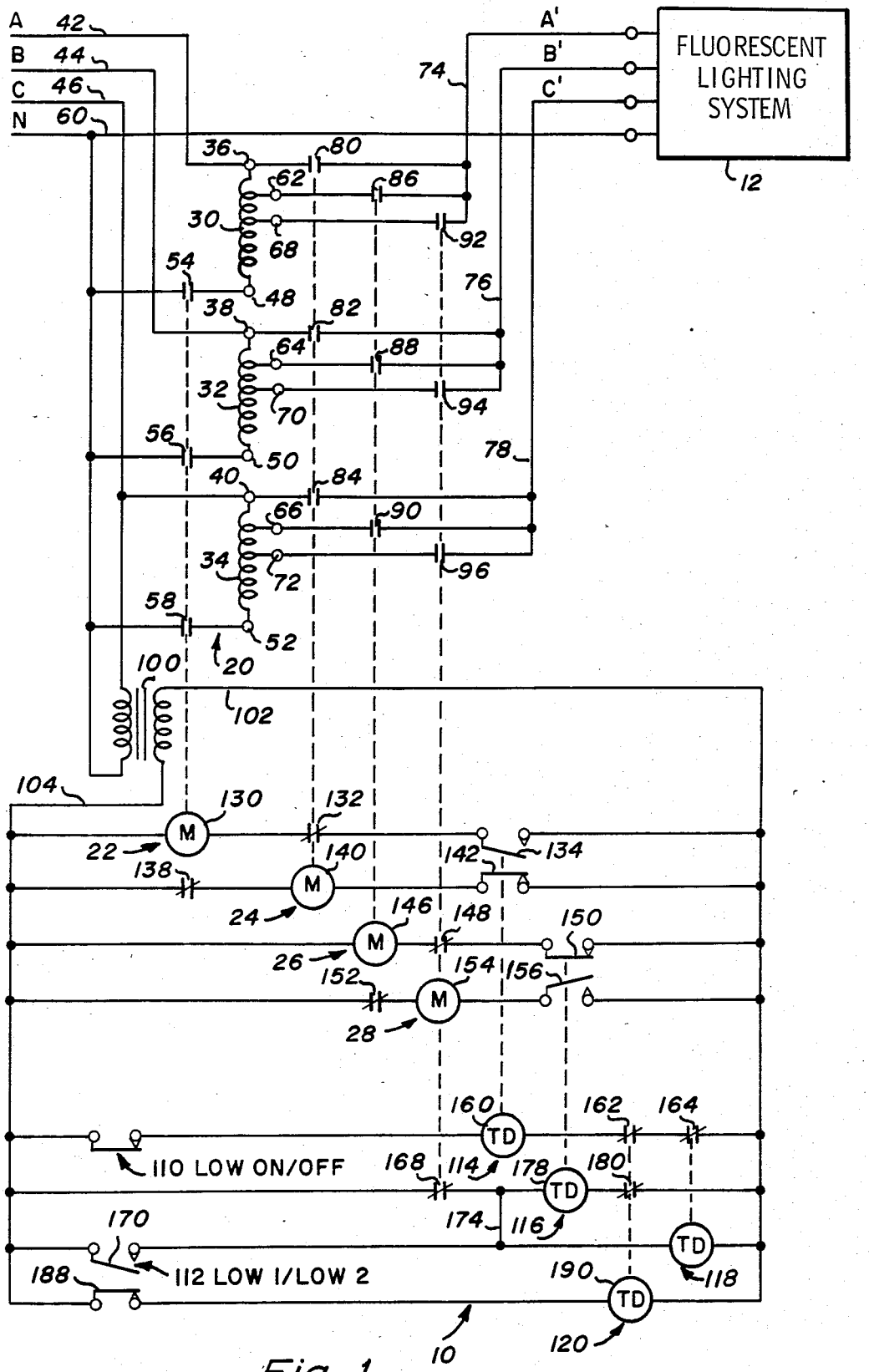

Shown in FIG. 1 of the drawing generally designated by the number 10 is a preferred embodiment in accordance with the present invention of a voltage controller for use with a fluorescent (or other gaseous-discharge-type) lighting system (as a load), the system being represented by a system 12. Controller 10 includes a three-phase transformer generally designated by a number 20 for developing reduced voltages and four contactors (relays) generally designated 22, 24, 26 and 28 for voltage switching.

More specifically, transformer 20 has three 277-volt auto-transformer windings, designated 30, 32 and 34, which are selectively coupled into a Y-configuration by contactor 22. The hot end of each of windings 30, 32 and 34, respectively designated 36, 38 and 40, is connected to a respective one of three hot lines, respectively designated 42, 44 and 46; and, the neutral end of each of the windings, respectively designated 48, 50 and 52, is selectively coupled by a respective set of contacts of three normally-open sets of contacts of contactor 22, respectively designated 54, 56 and 58, to a neutral line 60. Hot lines 42, 44 and 46 and neutral line 60 are for connection to respective lines of a three-phase four-line 480-volt (AC-voltage-supplying) power system. Each of the windings of transformer 20 develops a first and a second reduced voltage suitable for the particular fluorescent lighting system (15, 20, 25 and 30 percent reductions being common). Windings 30, 32 and 34 each develop the first reduced voltage at a respective one of three taps, respectively designated 62, 64 and 66, and the second reduced voltage at a respective one of three taps, respectively designated 68, 70 and 72.

With the full power-system voltages (which are employed as the fluorescent-lamp-starting voltages), the voltages developed by transformer 20 are selectively coupled by contactors 24, 26 and 28 to three additional hot lines, designated 74, 76 and 78, which, with neutral line 60, are for connection to the fluorescent-lighting system, as illustrated, system 12. Each of the fluorescent-lamp-starting voltages developed at a respective one of the ends 36, 38 and 40 is selectively coupled by a respective set of contacts of three normally-open sets of contacts of contactor 24, respectively designated 80, 82 and 84, to a respective one of lines 74, 76 and 78. Additionally, each of the first reduced voltages developed at a respective one of the taps 62, 64 and 66 is selectively coupled by a respective set of contacts of three normally-open sets of contacts of contactor 26, respectively designated 86, 88 and 90, to a respective one of the lines 74, 76 and 78; and, each of the second reduced voltages developed at a respective one of the taps 68, 70 and 72 is selectively coupled by a respective set of contacts of three normally-open sets of contacts of contactor 28, respectively designated 92, 94 and 96, to a respective one of the lines 74, 76 and 78.

Voltage controller 10 includes a step-down transformer 100 for powering the controller. Transformer 100 has a 277-volt primary winding connected between lines 46 and 60 and a 110-volt secondary winding connected between a pair of lines designated 102 and 104.

For controlling the energization of the contactors (switching the contactors), voltage controller 20 includes a low on/off switch 110, a two-pole low one/low two switch 112, and four time delay relays 114, 116, 118 and 120. Relays 114 and 116 are of the type which close a preset period of time following energization, commonly referred to as "on-delay-type" relays. Preferably, relays 114 and 116 are of the type which are designated 80E2A607 by the Eagle Signal Company, relay 114 being set for a 60-second delay period and relay 116 being set for a 5-second delay period. Relays 118 and 120 are of the type which close for a preset period following energization, commonly referred to as "one-shot" relays. Preferably, relays 118 and 120 are of the type which are designated 84E2A604 by the Eagle Signal Company, both being set for a 2-second "delay period."

The coil of contactor 22, designated 130, a normally-closed set of contacts 132 of contactor 24 and a normally-open set of contacts 134 of relay 114 are connected in series between lines 104 and 102. Also connected between lines 104 and 102 are the series combination of a normally-closed set of contacts 138 of contactor 22, the coil of contactor 24, designated 140, and a normally-closed set of contacts 142 of relay 114; the series combination of the coil of contactor 26, designated 146, a normally-closed set of contacts 148 of contactor 28, a normally-closed set of contacts 150 of relay 116; and the series combination of a normally-closed set of contacts 152 of contactor 26, the coil of contactor 28, designated 154, and a normally-open set of contacts of relay 116, designated 156. Contact sets 134 and 142 are of the "break-before-make" type as are contact sets 150 and 156.

The contacts of switch 110, the coil of relay 114, designated 160, a normally-closed set of contacts of relay 120, designated 162, and a normally-closed set of contacts of relay 118, designated 164, are connected in series between lines 104 and 102. Another set of normally-open contacts of contactor 28, designated 168, and a set of contacts of switch 112, designated 170, are connected in parallel between line 104 and a line 174. Connected between lines 174 and 102 is the series combination of the coil of relay 116, designated 178, and another normally-open set of contacts of relay 120, designated 180, in parallel combination with the coil of relay 118, designated 184. Finally, the series combination of another set of contacts of switch 112, designated 188, and the coil of relay 120, designated 190, is connected between lines 104 and 102.

Operationally, when the contacts of low on/off switch 110 are open (low off), relay 114 is deenergized. Consequently, contactor 22 is deenergized; and, contactor 24 is energized. While energized, contactor 24 couples the full power-system voltages (fluorescent-lamp-starting voltages) to lines 74, 76 and 78 to drive the lighting system, system 12.

In addition, depending upon the state of low one/low two switch 112, either contactor 26 or contactor 28 is energized. However, since contactor 22 is deenergized, the transformer 20 neutral-line connections are open. With the neutral-line connections open, transformer 20 does not operate as a transformer. Rather, each of the windings of transformer 20 operates as a simple inductor to, with the respective contact set of contactors 26 or 28, provide a redundant path to couple a respective full power-system voltage to the fluorescent-lighting system. For purposes of discussion, it is assumed that low one/low two switch 112 is in the state in which contact set 170 is open and contact-set 188 is closed (low one). In this state, relay 116 is deenergized. As a result, contactor 26 is energized and contactor 28 is deenergized.

The present period of time after low on/off switch 110 is closed (low on) (preferably 60 seconds), relay 114 contact set 142 opens deenergizing contactor 24. Although contactor 24 no longer couples the full power-system voltages to the fluorescent-lighting system, as previously indicated, such coupling is provided by contactor 26 in conjunction with the windings of transformer 20 operating as simple inductors. Moments after contact set 142 opens, contact set 134 closes, energizing contactor 22 to complete the transformer 20 winding-neutral connections. With the energization of contactor 22, each of the windings of transformer 20 now operates as an auto-transformer winding to develop a first-reduced voltage at a respective one of taps 62, 64 and 66. Each of the first reduced voltages is coupled to the fluorescent-lighting system by the respective contact set of contactor 26 (which is still closed). The break-before-make switching action of contact sets 134 and 142 prevents contactors 22 and 24 from being energized simultaneously. Contact sets 132 and 138 provide similar, redundant, protection.

When low one/low two switch 112 is switched to the state in which contact set 170 is closed (low two), relay 118 is energized, opening contact set 164 for the relay 118 preset period. While contact set 164 is open, relay 114 is deenergized. Contact set 134 opens, deenergizing contactor 22 to open the transformer 20 winding-neutral connections. Thereafter, contact set 142 closes, energizing contactor 24 to, redundantly, couple the full power-system voltages to the fluorescent-lighting system. Following the relay 116 preset period, contactor 26 is deenergized and contactor 28 is energized. Finally, following the relay 114 preset period (60 seconds) relay 114 contact set 142 opens. Finally, relay 114 contact set 134 closes, closing the transformer 20 winding-neutral connections. As a result, the second-reduced voltages are coupled to the fluoescent-lighting system, system 12.

When low on/off switch 110 is opened (low off) relay 114 opens contact set 134, opening the transformer winding-neutral connections. Next, contact set 142 closes, energizing contactor 24 to, redundantly, couple the full power-system voltages (fluorescent-lamp-starting voltages) to the fluorescent-lighting system. Thus, voltage controller 10 is reset (recycled to the state in which full power-system voltages are coupled to the fluorescent-lighting system, system 12).

For clarity, voltage controller 10 is illustrated as including simple switches, specifically, switches 110 and 112. As is appropriate for the particular fluorescent-lighting system, timer-driven switches, or relays, may be employed. Additionally, switches or relays driven in response to an external stimulus, such as the natural-lighting levels, may be employed.

Although a simple transformer, specifically transformer 20, having three auto-transformer windings is preferred, three transformers each having a single auto-transformer winding may, alternatively, be employed. Additionally, two series connected transformer windings, either aiding or bucking, may be employed as an auto-transformer winding. To permit the level of the reduced voltages to be periodically changed, as the lamps age, a variac with/or without an aiding/bucking transformer may be employed.

Figure 2:
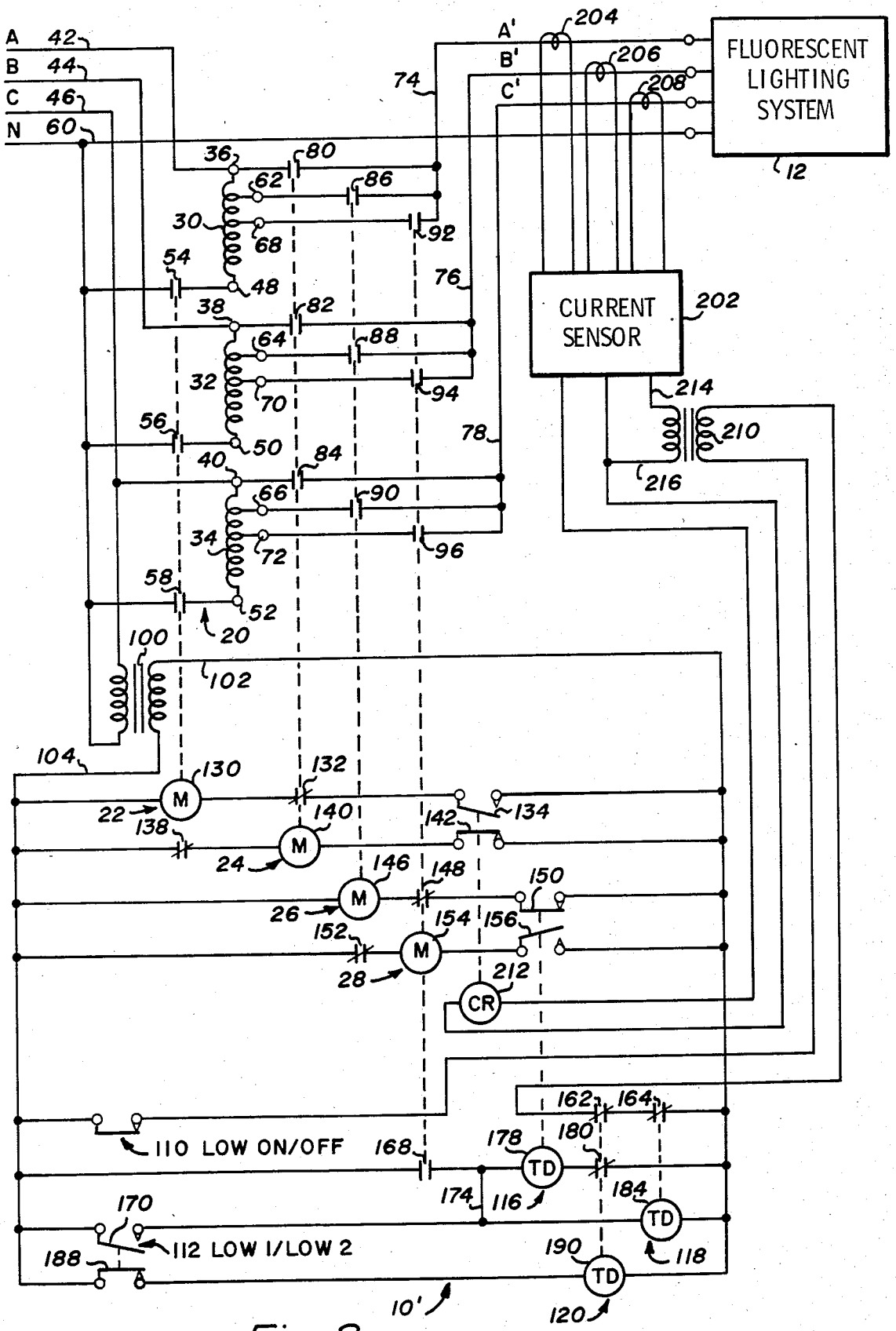

Turning now to FIG. 2, another preferred embodiment of a voltage controller in accordance with the present invention is illustrated generally designated by the number 10'. Rather than relay 160 (included in the embodiment illustrated in FIG. 1), voltage controller 10' includes a current sensor 202, three current transformers, designated 204, 206 and 208, a step-down transformer 210 and a relay 212. Each of current transformers 204, 206 and 208 is electrically connected to current sensor 202 and magnetically coupled to a respective one of lines 74, 76 and 78 to develop a current-sensor-driving signal responsive to the level of the current flowing in the respective line. Step-down transformer 210 has a 110-volt primary winding connected in series with switch 110 and contact sets 162 and 164 between lines 104 and 102. Additionally, transformer 210 has a 24-volt secondary winding connected to current sensor 202 by a pair of lines designated 214 and 216. Also connected to current sensor 202 is relay 212, being connected by a line 218 and line 216. Relay 212 has two sets of contacts, designated 134' and 142', connected as are their similarly designated counterparts in the embodiment illustrated in FIG. 1.

In general, voltage controller 10' operates in a fashion similar to that previously described (in conjunction with the embodiment illustrated in FIG. 1). A preset period (preferably 60 seconds) following the closure of low on/off switch 110 (low on), relay 212 contact set 142' opens, deenergizing contactor 24; and, thereafter, relay 212 contact set 134' closes, energizing contactor 22. Additionally, responsive to the opening of either contact set 162 or contact set 164, voltage controller 10' is reset (recycled to the state in which the controller couples the full power-system voltages, fluorescent-lamp-starting voltages, to the lighting system, system 12).

Responsive to signals indicating an increase in the level of current flow through one or more of lines 74, 76 or 78 developed by current transformers 204, 206 and 208, current sensor 202 briefly deenergizes relay 212 to reset (recycle) voltage controller 10'. This permits an individual light of the fluorescent-lighting system, system 12, to be turned off and on. The increased current flow developed when the light is turned on causes voltage controller 10' to be reset (recycled) to the state in which the full power-system voltages are coupled to the fluorescent-lighting system, system 12, for lamp starting.

Thus, the method may be seen to include the steps of coupling the full power-system voltages to the lighting system for lamp starting; coupling an auto-transformer winding to the power-system to develop reduced voltages and coupling the reduced voltages to the lighting system during the period in which energy is to be conserved; and opening the winding-power-system neutral line connection and switching the voltages in closed transition fashion when changing states.

It is anticipated that after having read the preceding disclosure certain alterations and modifications will no doubt become apparent to those skilled in the art. It is therefore intended that the following claims be interpreted to cover all such alterations and modifications as fall within the true spirit and scope of the invention.

What is claimed is:

1. A voltage controller for connection between an AC-voltage-supplying system and a lighting system employing gaseous-discharge-type lamps, the voltage controller for coupling the full AC voltage to the lighting system for lamp starting and the voltage controller for developing a reduced voltage from the AC voltage and for coupling the reduced voltage to the lighting system during a predetermined period for power conservation, the voltage controller comprising in combination:

a neutral line;

a supply-system-hot line with said neutral line for connection to the supplying system to receive the AC voltage;

a lighting-system-hot line with said neutral line for connection to said lighting system to transmit power thereto;

a neutral-contactor means having a neutral-contact-set means;

a full-voltage-contactor means having a full-voltage-contact-set means;

a coupling means;

a transformer means including an auto-transformer-winding means having a hot-end means connected to said supply-system-hot line and selectively coupled by said full-voltage-contact-set means to said lighting-system-hot line, a neutral-end means selectively coupled by said neutral-contact-set means to said neutral line, and a tap means coupled to said lighting-system-hot line by said coupling means, said winding means for developing the reduced voltage between said tap means and said neutral-end means when said AC voltage is developed between said hot-end means and said neutral-end means; and a contactor-switching means for causing said neutral-contact-set means to be open and said full-voltage-contact-set means to be closed for lamp starting and for causing said neutral-contact-set means to be closed and said full-voltage-contact-set means to be open during the predetermined period for power conservation, said contactor switching means being operative to open said full-voltage-contact-set means before closing said neutral-contact set means when switching from the lamp-starting state to the energy conserving state and operative to open said neutral-contact-set means before closing said full-voltage-contact-set means when switching from said power conserving state to said lamp-starting state.

2. A voltage controller as recited in claim 1 further including a means for monitoring the level of current flow in said lighting-system-hot line and responsive to an increase therein operative to cause said contactor-switching means to switch to said lamp-starting state.

3. A voltage controller as recited in claim 1 wherein said coupling means includes a first-tap contactor means having a first-tap-contact-set means connected between said tap means and said lighting-system hot line, wherein said voltage controller further comprises a second-tap contactor means having a second-tap-contact-set means, wherein said winding means further has another tap means coupled by said second-tap-contact-set means to said lighting-system-hot line, wherein said contactor switching means further causes said first-tap-contactor-set means to be closed and said second-tap-contact-set means to be open in said power conserving state, wherein said contact-switching means causes said neutral-contact-set means to be closed, said second-tap-contactor-set means to be closed, said first-tap-contact-set means to be open and said full-voltage-contact-set means to be open in a further-reduced-power-conserving state, and wherein said contactor switching means switches between said states in closed transition fashion with said neutral-contact-set means open.

4. A voltage controller as recited in claim 3 further including a means for monitoring the level of current flow in said lighting-system-hot line and responsive to an increase therein operative to cause said contactor-switching means to switch to said lamp-starting state.

5. A voltage controller for connection between a three-phase AC-voltage-supplying system and a lighting system employing gaseous-discharge-type lamps, the voltage controller for coupling the full AC voltages to the lighting system for lamp starting and the voltage controller for developing reduced voltages from the AC voltages and for coupling the reduced voltages to the lighting system during a predetermined period for power conservation, the voltage controller comprising in combination:

a neutral line;

a first, a second and a third supply-system-hot line with said neutral line for connection to the supplying system to receive the AC voltages;

a first, a second and a third lighting-system-hot line with said neutral line for connection to the lighting system to transmit power thereto;

a neutral-contactor means having a first, a second and a third contact-set means;

a full-voltage-contactor means having a first, a second and a third contact-set means;

a coupling means;

transformer means including a first, a second and a third auto-transformer-winding means each having a hot-end means connected to a respective one of said supply-system-hot lines and selectively coupled by a respective one of said contact-set means of said full-voltage-contactor means to a respective one of said lighting-system-hot lines, a neutral-end means selectively coupled by a respective one of said contact-set means of said neutral-contactor means to said neutral line, and a tap-means coupled to a respective one of said lighting-system-hot lines by said coupling means, each of said winding means for developing one of the reduced voltages between the winding means tap means and the winding means neutral-end means when one of the AC voltages is developed between the winding means hot-end means and the winding means neutral-end means; and a contactor-switching means for causing the various contact-set means of said neutral-contactor means to be open and the various contact-set means of said full-voltage-contactor means to be closed for lamp starting and for causing the various contact-set means of said neutral-contactor means to be closed and the various contact-set means of said full-voltage-contactor means to be open during the predetermined period for power conservation, said contactor-switching means being operative to open the various contact-set means of said full-voltage-contactor means before closing the various contact-set means of said neutral-voltage-contactor means when switching from the lamp-starting state to the energy conserving state and operative to open the various contact-set means of said neutral-contactor means before closing the various contact-set means of full-voltage-contactor means when switching from said power conserving state to said lamp-starting state.

6. A voltage controller as recited in claim 5 further including a means for monitoring the level of current flow in at least one of said lighting-system-hot lines and responsive to an increase therein operative to cause said contactor-switching means to switch to said lamp-starting state.

* * * * *